US005937666A

United States Patent [19]

Trulaske, Sr.

[11] Patent Number: 5,937,666

[45] Date of Patent: Aug. 17, 1999

[54] REFRIGERATOR UNIT WITH LIGHTED DOOR

[75] Inventor: Robert J. Trulaske, Sr., St. Louis, Mo.

[73] Assignee: True Manufacturing Company, Inc., O'Fallon, Mo.

[21] Appl. No.: 08/995,956

[22] Filed: Dec. 22, 1997

Related U.S. Application Data

[63] Continuation of application No. 08/536,465, Sep. 29, 1995, Pat. No. 5,699,676.

[51] Int. Cl.[6] ..... F25D 23/02

[52] U.S. Cl. ..... 62/264; 362/125

[58] Field of Search ..... 62/264; 362/92, 362/125; 49/501

[56] References Cited

U.S. PATENT DOCUMENTS

| | | | |
|---|---|---|---|
| 1,607,922 | 11/1926 | Schweitzer | 362/125 |
| 2,163,562 | 6/1939 | Putman et al. | 362/125 |
| 2,438,972 | 4/1948 | Hoffman | 62/264 |
| 2,816,318 | 12/1957 | Philipp | 62/264 |
| 4,072,486 | 2/1978 | Joseph | 62/264 |
| 5,136,492 | 8/1992 | Rush | 362/125 |
| 5,301,092 | 4/1994 | Santosuosso et al. | 362/125 |

*Primary Examiner*—William E. Tapolcai
*Attorney, Agent, or Firm*—Cohn, Powell & Hind

[57] ABSTRACT

This refrigerator unit (10) with a lighted door (20) includes a cabinet (12) defining a front opening (18). The door (20) is mounted to the cabinet (12) and includes a door frame (22) having top and bottom framing members (26 and 28) and side framing members (30 and 31). A lighting assembly (100, 200) is disposed adjacent one of the side framing members (30), and includes a base member (102, 202) which extends between the top and bottom framing members (26, 28) and conceals the lighting (134, 234) from sight outside of the refrigerator unit (10).

3 Claims, 5 Drawing Sheets

REFRIGERATOR UNIT WITH LIGHTED DOOR

This application is a continuation of application Ser. No. 08/536,465 filed Sep. 29, 1995 now U.S. Pat. No. 5,699,676.

BACKGROUND OF THE INVENTION

This invention relates to interior lighting for refrigerator units such as merchandisers having cabinets with glass doors, and particularly to concealed lighting provided on the inside of the cabinet doors.

Lighting is necessary within refrigerator units and particularly free standing merchandisers of the type under consideration. Such lighting is usually provided by means of elongate fluorescent tubes and is commonly provided in the upper portion of the cabinet. This arrangement illuminates the upper shelving well but is not entirely satisfactory for illuminating the lower shelving. Lighting can also be provided at the rear or the sides of the cabinet. However, this arrangement tends to be unsightly because the lighting assembly is visible from the outside of the unit through the glass doors.

This invention provides concealed door lighting which solves the above problems in a manner not revealed by the known prior art.

SUMMARY OF THE INVENTION

This invention provides door mounted lighting for free standing refrigerator units having cabinets with glass doors, the lighting being substantially concealed from view from the outside of the cabinet when the door is closed and provides minimum interference with the available cabinet storage space.

This refrigerator unit with a lighted door, comprises a cabinet including a top, bottom and opposed sides defining a front opening; a door including a door frame and means mounting the door frame to said cabinet, said door frame having an inside and outside and including a top framing member, a bottom framing member, opposed side framing members and a glass panel; and a lighting assembly including a base member having opposed ends and disposed adjacent one of said side framing members and extending substantially between said top and bottom door framing members and top and bottom light holding fixtures at each end of said base member and a lighting element extending between said light holding fixtures.

It is an aspect of this invention to provide that said door side frame includes a pair of inwardly projecting arms; and said lighting assembly base member interfits said inwardly projecting arms and includes a pair of inwardly projecting arms receiving said glass panel, said base providing a fill member between said glass panel and said side framing member.

It is another aspect of this invention to provide that said lighting assembly base member includes a pair of rearwardly projecting arms and a generally U-shaped cover interfitting said rearwardly projecting arms.

It is yet another aspect of this invention to provide that said cover interfits said rearwardly projecting arms in snap-fitting relation.

It is still another aspect of this invention to provide that one of said base member projecting arms is inclined toward said other projecting arm to hold said glass panel in place.

It is an aspect of this invention to provide that said one of said inwardly projecting arms is turned rearwardly to provide one of said cover receiving arms.

It is another aspect of this invention to provide in, a modified unit that said door side frame includes a pair of inwardly projecting arms receiving said glass panel; and said lighting assembly base member includes an outer side arm received between one of said side frame projecting arms and said glass panel.

It is yet another aspect of this invention to provide in said modified unit that said base member includes a U-shaped portion having a bight portion and said received arm includes an end hook portion cooperating with said glass panel to hold said base member in place.

It is still another aspect of this invention to provide in said modified unit that said U-shaped portion of said base member operatively receives said light holding fittings.

It is an aspect of this invention to provide that said door frame is mounted to one of said cabinet sides in swinging relation.

These door mounted lighting assemblies are relatively simple to manufacture and readily adaptable for use with easily modified conventional refrigerator units.

DESCRIPTION OF THE PREFERRED EMBODIMENT

Figure 1:
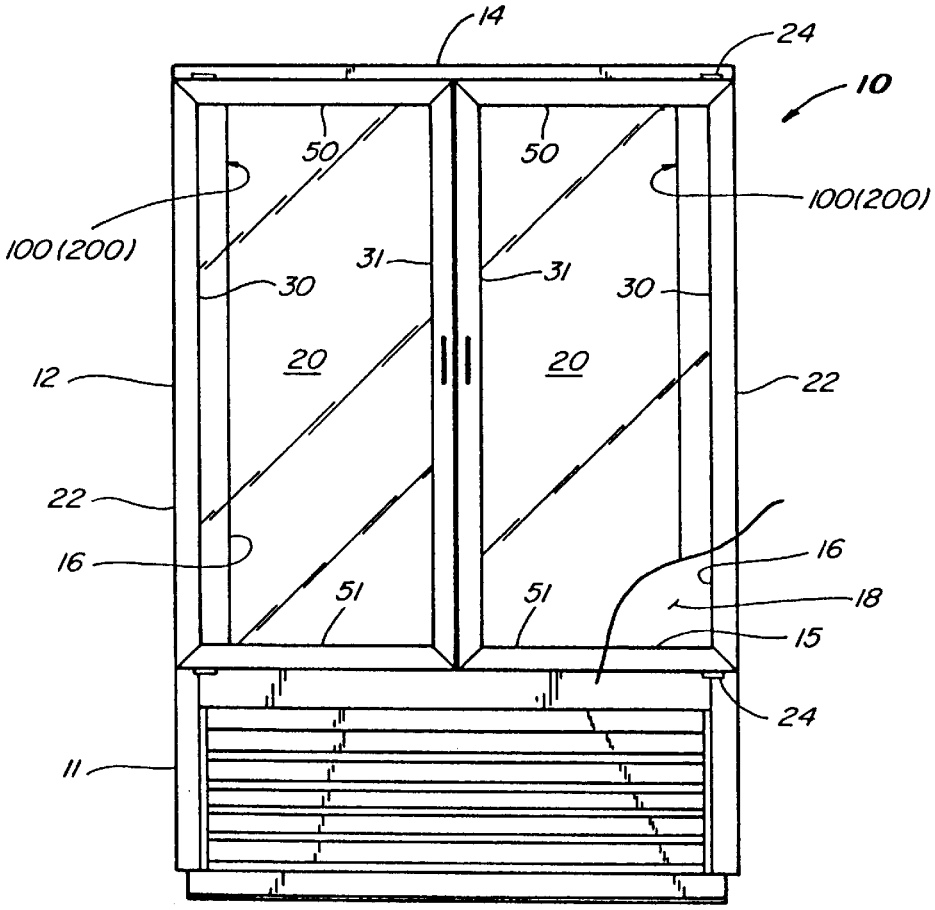
FIG. 1 is a front view of a refrigerator unit using the door mounted lighting system.
Figure 2:
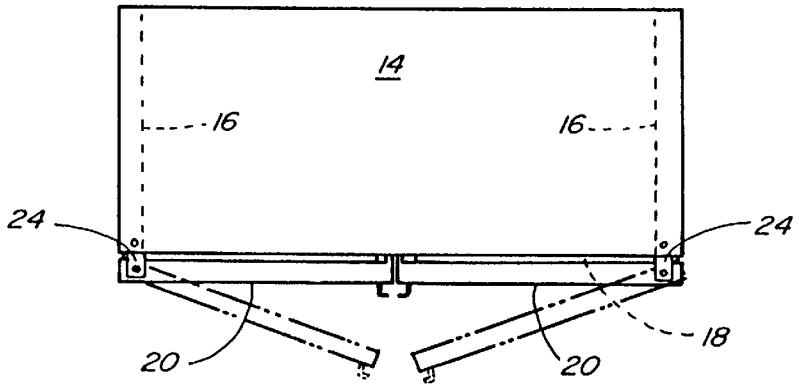
FIG. 2 is a plan view of the unit.
Figure 3:
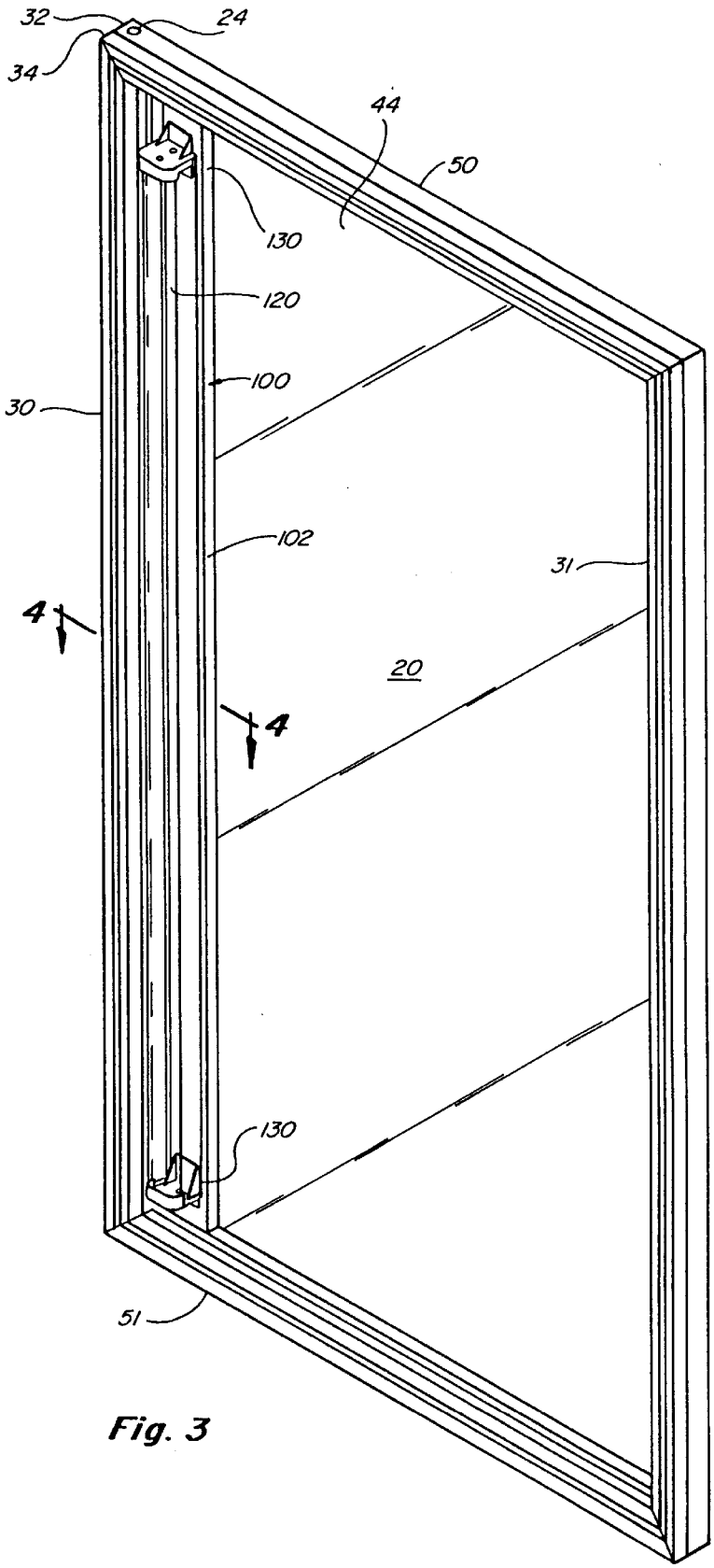
FIG. 3 is a perspective view of the inside of a door frame.

Referring now by reference numerals to the drawings and first to FIGS. 1–3, it will be understood that the refrigeration unit shown is a merchandiser 10 which includes a lower portion providing a compressor housing 11 and an upper portion providing a cabinet 12. As shown, the cabinet 12 includes a top 14, a bottom 15 and opposed sides 16 defining an opening 18. The opening 18 in the embodiment shown includes a pair of doors 20 which are substantially identical, each door 20 being attached to one of said cabinet sides 16 in swinging relation to said door opening 18.

Each door 20 includes a door frame 22 and a top and bottom pivot attachment means 24, by which it is attached to the cabinet 12. Each door frame 22 includes a top framing member 50, a bottom framing member 51 and side framing members 30 and 31. The cross section of the top, bottom and side framing members, which are mitered at the corners, is substantially the same. The side framing members 30 and 31 are substantially identical and will be described with reference to side framing member 30 which is adapted to suit a lightening assembly 100 as will be described. The top and bottom framing members 50 and 51 are substantially identical and will be described with reference to the top framing member 50.

Figure 4:
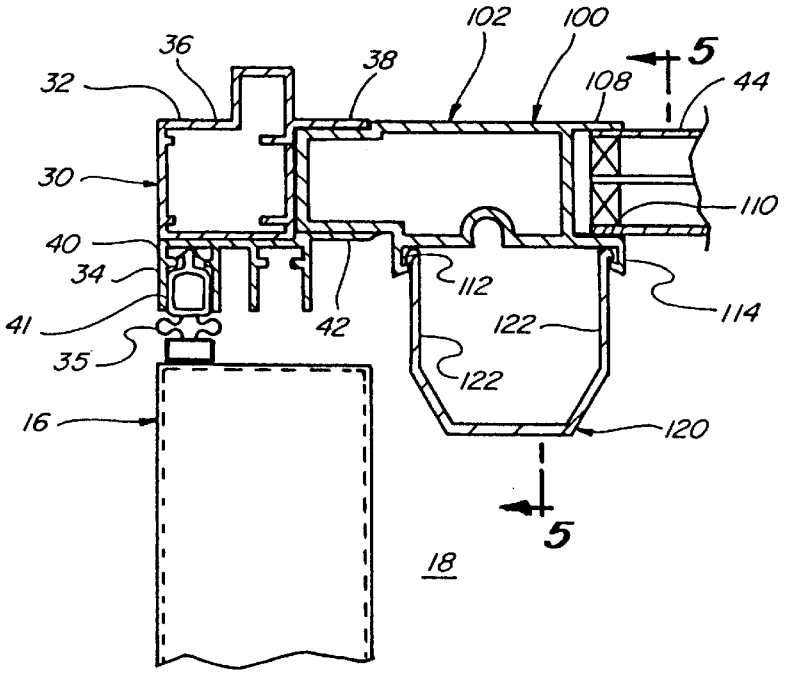
FIG. 4 is a cross-sectional view taken on Line 4—4 of FIG. 3.
Figure 5:
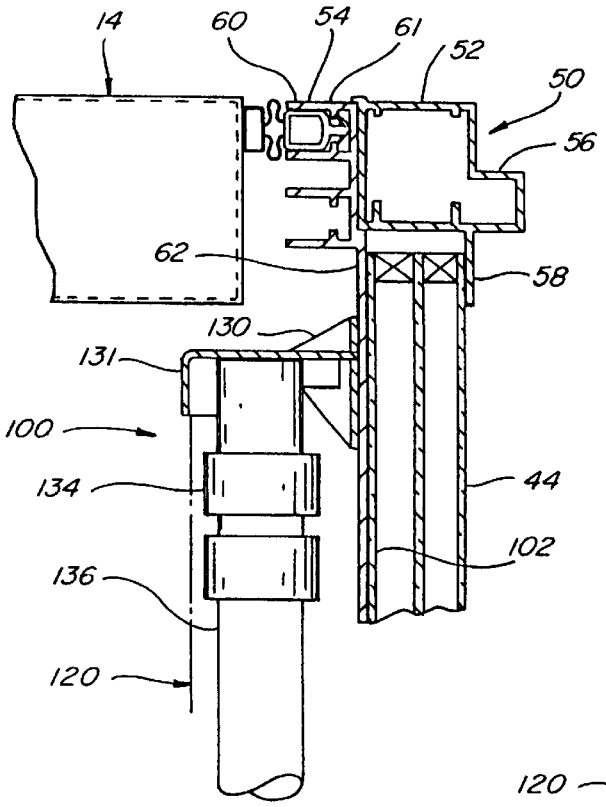
FIG. 5 is a cross-sectional view taken on Line 5—5 of FIG. 4.

As shown in FIG. 4, the framing member 30 includes an outside member 32 and an inside member 34 attached to said outside member 32, as by threaded fasteners (not shown). The outside framing member 34 includes a generally box-shaped portion 36 having an inwardly projecting arm 38. The inside member 34 includes a multi-channel portion 40 accommodating a door seal 41 cooperating with the seal 35 at the end of the cabinet side 16, and an inwardly projecting arm 42. The opposed arms 38 and 42 of the side framing member 30 would normally receive a glass panel 44 if they were used for conventional door framing construction but instead are adapted to cooperate with a lighting assembly 100 as will be described below. As shown in FIG. 5, the framing member 50 includes an outside member 52 and an inside member 54. The outside member 52 includes a generally box-shaped member 56 having an inwardly projecting arm 58. The inside member 54 includes a multi-channel portion 60 accommodating a door seal 61 cooperating with the end of the cabinet top 14, and an inwardly projecting arm 62. The opposed arms 58 and 62 would normally receive the glass panel 44 along their entire length if they were used for conventional door framing construction. However, the door frame 22 is modified to cooperate with lighting assembly 100 disposed adjacent the side framing member 50, as will now be described.

The lighting assembly 100 is shown in FIGS. 3–6 and includes a box section base member 102 which provides a filler panel between the glass panel 44 and the side framing member 30. As shown in FIG. 4 the base member 102 includes a reduced portion 104 configurated to be received in fitted relation between the side framing arms 38 and 42. The base member 102 also includes opposed, inwardly projecting arms 108 and 110, adapted receive the glass panel 44 which, in a conventional door, would be received between arms 38 and 42. To this end, the inner projecting arm 110 is inwardly inclined to receive the glass panel 44 in sprung relation. The base member 102 also includes a rearwardly projecting end member 112 which cooperates with a rearwardly projecting member 114 at the end of the inwardly projecting arm 110, said members 112 and 114 having a hooked configuration. The members 112 and 114 cooperate with the hooked arms 122 of U-shaped light cover 120 to hold said light cover in snap-fitted relation. The base member 102 also includes an elongate recess 124 which provides an electric cable conduit. A shown in FIG. 5, the relatively narrow glass panel 44 is received at its upper and lower ends within the side framing arms 58 and 62. The base member 102 upper and lower ends are adapted to be received between said arms 58 and 62 as by providing reduced end portions.

Figure 6:
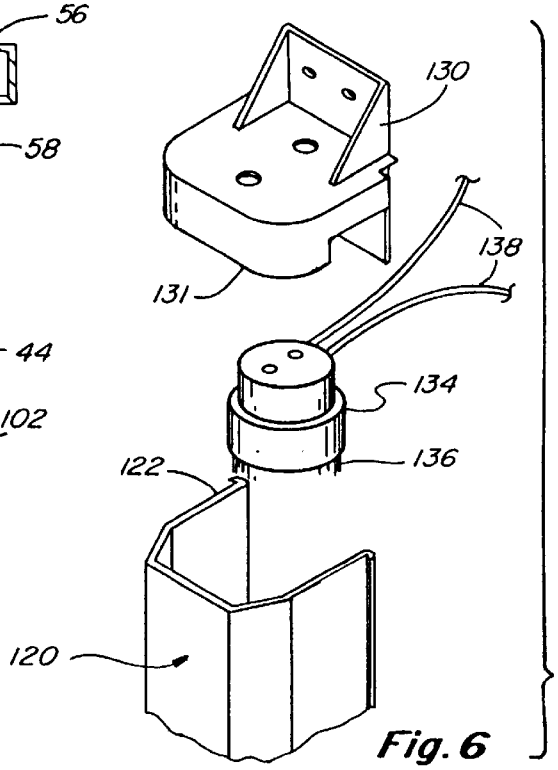
FIG. 6 is a fragmentary perspective view of the lighting assembly fittings.
Figure 7:
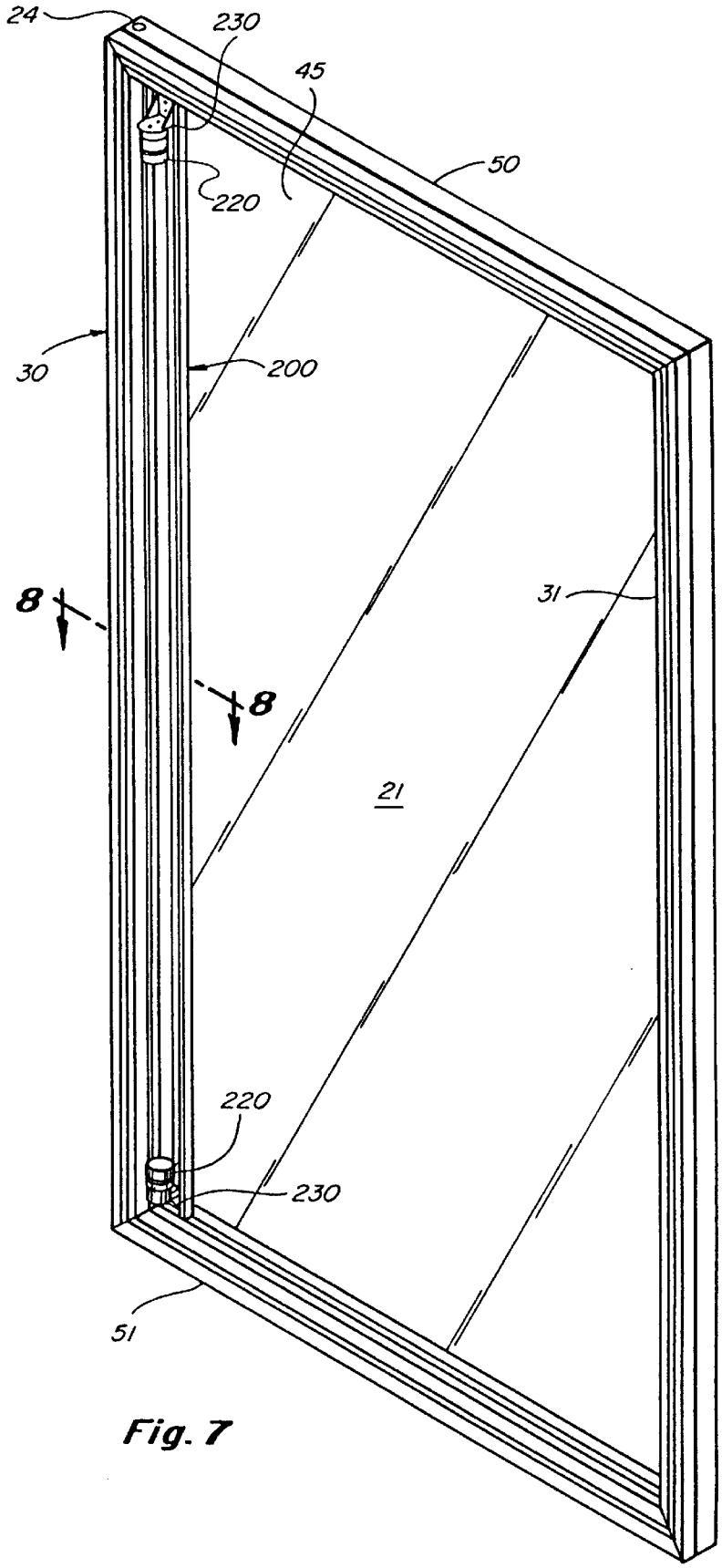
FIG. 7 is a perspective view of the inside of a modified door frame.
Figure 8:
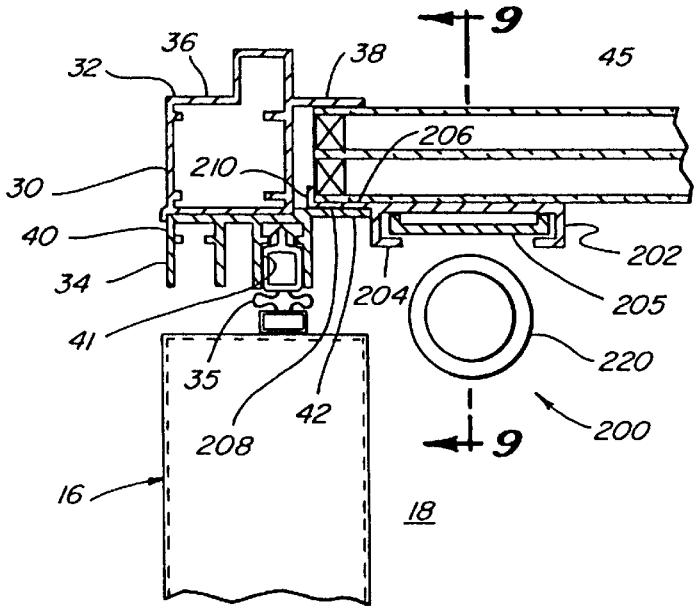
FIG. 8 is a cross-sectional view taken on Line 8—8 of a of FIG. 7.

As best shown in FIGS. 5 and 6, the upper and lower ends of the base member 102 are provided with identical top and bottom caps 130 for the cover 120. The caps 130 include a rim 131, which is slightly larger than the cover 120 and receives said cover in capped relation. The caps 130 are attached to said base member 102 as by threaded fasteners (not shown). In the embodiment shown, the caps 130 receive the ends of a telescopic lamp holder 134 for a fluorescent tube 136, said lamp holders being connected by conductors 138.

A second lighting assembly 200 is shown in FIGS. 7–10. The side framing members 30 and top framing member 50 have already been described. However, the cooperation of these framing members with the second lighting assembly 200 is different from that for the first light framing assembly 100 as will now be described.

Figure 9:
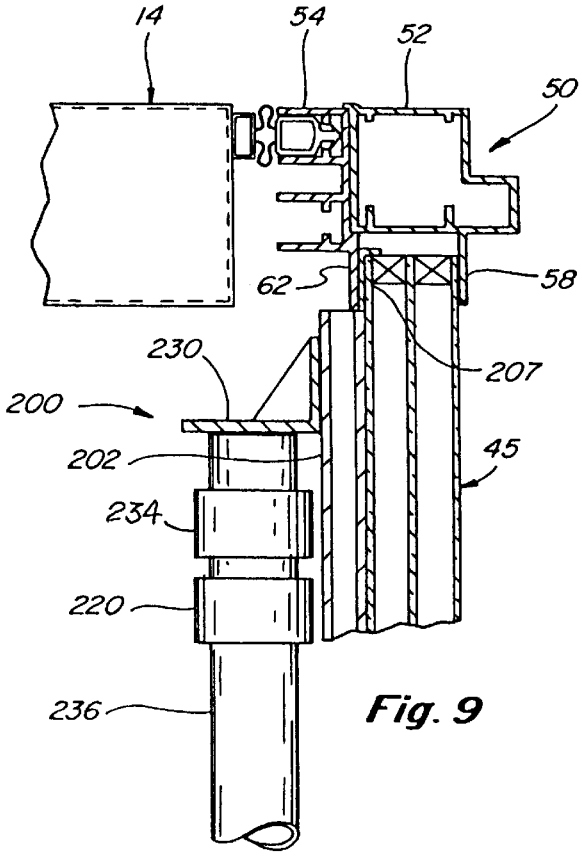
FIG. 9 is a cross-sectional view taken on Line 9—9 of FIG. 8.
Figure 10:
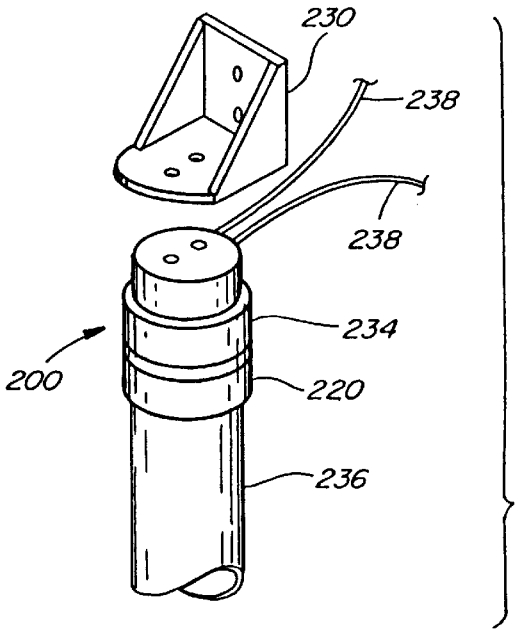
FIG. 10 is a fragmentary perspective view of the lighting assembly fittings of the door of FIG. 7.

The second lighting assembly 200 includes a base member 202 having a U-shaped portion 204 having an ell-shaped portion 206. The base member 202 also includes a coextensive support member 205 attached thereto. The ell-shaped portion long arm 208 is received in fitted relation between the side frame member arm 38 and the glass panel 45. The short arm 210 is retained by the side of the glass panel 45. As shown in FIG. 9, the U-shaped portion 204 and the support member 205 extend substantially between the top and bottom frame members 50 and 51, the support 205 being configurated for attachment of the upper and lower end caps 230 as by fasteners.

In the embodiment shown, the end caps 230 also receive the ends of a telescopic lamp holder 234 for fluorescent tube 236 and are attached to the base member 202 as by threaded fasteners (not shown) and the lamp holders 234 are connected by conductors 238. A lamp shield 220 is provided for the fluorescent tube. An ell-shaped portion 207 is provided fixedly attached as by welding to the upper and lower ends of the base member 202 cooperating with the side framing member 62 and the end of the glass panel 45 and having the same function as the ell-shaped member 206 to hold the base member 202 in place.

The light assemblies 100 and 200 function similarly in that they provide a concealed light at one side of their associated modified door 20 or 21. They are different, however, in that in the case of light assembly 100, the base member 102, in effect, forms an auxiliary side framing member, which provides a filler panel and requires a narrower glass panel 44. In the case of light assembly 200 the base member 202 is essentially laid on the interior of the glass panel and held in place against said glass panel 45, which is of standard width, by the ell-shaped arms 206 and 207.

In view of the above, it will be seen that various aspects and features of the invention are achieved and other advantageous results attained. While preferred embodiments of the invention have been shown and described, it will be obvious to those skilled in the art that changes and modifications may be made therein without departing from the invention in its broader aspects.

I claim as my invention:

1. A refrigerator unit with a lighted door, comprising:

(a) a cabinet including a top, bottom and opposed sides defining a front opening;

(b) a door including a door frame and means mounting the door frame to said cabinet, said door frame having an inside and outside and including a top framing member, a bottom framing member, opposed side framing members and a glass panel having an exterior face and an interior face; and (c) a lighting assembly mounted on the door including a base member having opposed ends and disposed adjacent one of said side framing members and extending substantially between said top and bottom door framing members and top and bottom light holding fixtures at each end of said base member and a lighting element extending between said light holding fixtures and being disposed outside of the glass panel rearwardly of said interior face of the glass panel.

2. A refrigerator unit with a lighted door, comprising (a) a cabinet including a top, bottom and opposed sides defining a front opening;

(b) a door including a door frame and means mounting the door frame to said cabinet, said door frame having an inside and outside and including a top framing member, a bottom framing member, opposed side framing members and a glass panel having an exterior face and an interior face, and (c) a lighting assembly including a base member having opposed ends and disposed on the door frame adjacent one of said side framing members and extending substantially between said top and bottom door framing members and top and bottom light holding fixtures at each end of said base member and a lighting element extending between said light holding fixtures and being disposed outside of the glass panel rearwardly of said interior face of the glass panel.

(d) said one of said side framing members being disposed in spaced relation from said glass panel; and (e) said lighting assembly base member being disposed between said side framing member and said glass panel, said base member providing a fill member between said glass panel and said side framing member.

3. A refrigerator unit with a lighted door, comprising:

(a) a cabinet including a top bottom and opposed sides defining a front opening;

(b) a door including a door frame and means mounting the door frame to said cabinet, said door frame having an inside and outside and including a top framing member, a bottom framing member, opposed side framing members and a glass panel having an exterior face and an interior face; and (c) a lighting assembly including a base member having opposed ends and disposed adjacent one of said side framing members and extending substantially between said top and bottom door framing members and top and bottom light holding fixtures at each end of said base member and a lighting element extending between said light holding fixtures and being disposed outside of the glass panel rearwardly of said interior face of the glass panel.

(d) said one of said door side framing members including at least one inwardly projecting portion overlapping said glass panel, and (e) said lighting assembly base member being disposed at least in part between said overlapping portion and said glass panel.

* * * * *